US006207071B1

(12) United States Patent
Takigawa et al.

(10) Patent No.: US 6,207,071 B1
(45) **Date of Patent: *Mar. 27, 2001**

(54) FLUID COMPOSITION COMPRISING HFC REFRIGERANT AND ALKYLBENZENE-BASED REFRIGERATOR OIL

(75) Inventors: Katsuya Takigawa; Umekichi Sasaki; Satoshi Suda, all of Yokohama (JP)

(73) Assignee: Nippon Mitsubishi Oil Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/943,998

(22) Filed: Oct. 3, 1997

Related U.S. Application Data

(63) Continuation of application No. 08/503,619, filed on Jul. 18, 1995, now abandoned.

(30) Foreign Application Priority Data

Jul. 19, 1994 (JP) ..... 6-187856
Jul. 19, 1994 (JP) ..... 6-187857

(51) Int. Cl.[7] ..... C09K 5/04
(52) U.S. Cl. ..... 252/68; 252/67
(58) Field of Search ..... 252/68, 67

(56) References Cited

U.S. PATENT DOCUMENTS 4,046,533 * 9/1977 Olund ..... 62/468
5,049,292 * 9/1991 Grasshoff et al. ..... 252/49.6
5,062,985 * 11/1991 Takemasa et al. ..... 252/67
5,154,846 * 10/1992 Thomas et al. ..... 252/68
5,262,076 * 11/1993 Ishida et al. ..... 252/52 A
5,310,492 * 5/1994 Seiki et al. ..... 252/68
5,368,765 11/1994 Kaneko ..... 252/68
5,391,311 * 2/1995 Ishida et al. ..... 252/52 A
5,431,835 * 7/1995 Katafuchi et al. ..... 252/68
5,520,833 * 5/1996 Kaneko ..... 252/68

FOREIGN PATENT DOCUMENTS

4226431 * 2/1994 (DE) .
2362857 7/1994 (DE) .
0205995 12/1986 (EP) .
0496937 8/1992 (EP) ..... C10M/129/18
0659862 * 6/1995 (EP) .
6184576 5/1989 (JP) .
5-93198 * 4/1993 (JP) .
6-184576 * 7/1994 (JP) .
6184576 7/1994 (JP) ..... C10M/111/02

* cited by examiner

*Primary Examiner*—Margaret Einsmann
(74) *Attorney, Agent, or Firm*—Morrison Law Firm

(57) ABSTRACT

A refrigerator oil for use with an HFC refrigerant containing HFC-134a and/or HFC-125, which comprises an alkylbenzene oil containing at least 60% by weight of alkylbenzenes having a molecular weight of 200 to 350. An oil composition for use in a refrigerator, which comprises the refrigerator oil mentioned above and an HFC refrigerant containing HFC-134a and/or HFC-125, together with or without an additive such as a phosphoric ester compound.

19 Claims, No Drawings

FLUID COMPOSITION COMPRISING HFC REFRIGERANT AND ALKYLBENZENE-BASED REFRIGERATOR OIL

This application is a continuing application of application Ser. No. 08/503,619, filed on Jul. 18, 1995, now abandoned.

BACKGROUND OF THE INVENTION

1. Field of the Invention

This invention relates to a refrigerator oil and a fluid composition for a refrigerator, and in particular to a refrigerator oil and a fluid composition containing said oil for use in a refrigerator, the refrigerator oil comprising an alkyl benzene having a specific feature and being suited for use with an HFC refrigerant containing 1,1,1,2-tetrafluoroethane (HFC-134a) and/or pentafluoroethane (HFC-125).

2. Prior Art

Due to the recent problems as to the destruction of the ozone layer, the use of CFC (chlorofluorocarbon) and HCFC (hydrochlorofluorocarbon) which have been conventionally used as a refrigerant for a refrigerator is now restricted under a regulation. Therefore, as a replacement of these materials, HFC (hydrofluorocarbon) has been increasingly employed as a refrigerant.

Under the circumstances, PAG (polyalkyleneglycol) and esters which are compatible with HFC have been studied or used as an oil for a refrigerator using an HFC refrigerant. For example, the use of PAG is proposed in U.S. Pat. No. 4,755.316; Japanese Patent Unexamined Publications No. Hei 1-198694, No. Hei 1-256594, No. Hei 1-259093, No. Hei 1-259094, No. Hei 1-259095, No. Hei 1-274191, No. Hei 2-43290, No. Hei 2-55791 and No. Hei 2-84491. The use of esters is proposed in PCT. Publication No. Hei 3-505602; Japanese Patent Unexamined Publications No. Hei 3-88892, No. Hei 2-128991, No. Hei 3-128992, No. Hei 3-200895, No. Hei 3-227397, No. Hei 4-20597, No. Hei 4-72390, No. Hei 4-218592 and No. Hei 4-249593.

However, PAG is rather high in hygroscopicity and poor in electric characteristics (volume resistivity). On the other hand, ester-based oils are readily hydrolyzed to generate an acid thus possibly giving rise to various problems. Moreover, these oils are accompanied with a serious problem that they are inferior in lubricity as compared with a mineral oil/CFC or a mineral oil/HCFC.

On the other hand, Japanese Patent Unexamined Publications No. Hei 5-157379 describes a refrigerating system for an HFC-134a refrigerant wherein there is used a refrigerator oil which is incompatible with a refrigerant. As an example of such an oil, an alkylbenzene is disclosed therein. However, it has been found that if an ordinary alkylbenzene is to be used as a refrigerator oil for HFC-134a and/or HFC-125, some specific means is required to be taken on the side of the system, and that if an ordinary alkylbenzene is used as a refrigerator oil for HFC-134a and/or HFC-125 without taking such specific means, the seizure of a refrigerating compressor used may possibly be caused after a long period of its operation.

The present inventors took notice of an alkylbenzene which is free from hydrolysis and hygroscopicity and made an extensive study to finally find out that if an alkylbenzene having a specific property is used as a refrigerator oil for HFC-134a and/or HFC-125, the seizure of the refrigerating compressor can be avoided, thus indicating an excellent lubricity of the alkylbenzene, and that the alkylbenzene is capable of maintaining a high reliability for a long period of time. This invention has thus been accomplished in one aspect.

It has further been found out by the present inventors that when a phosphoric ester compound is added in a specific ratio to the above alkylbenzene having a specific property and the resulting mixture is used as a refrigerator oil in a refrigerator, the wear resistance and load resistance of the refrigerator can be improved. This invention has thus been accomplished in another aspect.

SUMMARY OF THE INVENTION

The object of the present invention is to provide a refrigerator oil to be used with an HFC refrigerant containing HFC-134a and/or HFC-125, which enables a refrigerating compressor to be prevented from its seizure, is excellent in lubricity and retains high reliability for a long period of time.

Another object of the present invention is to provide a fluid composition for use in a refrigerator, which comprises the above refrigerator oil and an HFC refrigerant containing HFC-134a and/or HFC-125.

In a first aspect of this invention, there is provided a refrigerator oil for use with an HFC refrigerant containing HFC-134a and/or HFC-125, which comprises an alkylbenzene oil containing 60% by weight or more of alkylbenzenes having a molecular weight of 200 to 350.

In a second aspect of this invention, there is provided an oil composition for use with an HFC refrigerant containing HFC-134a and/or HFC-125, which comprises, as a base oil, an alkylbenzene oil containing 60% by weight or more of alkylbenzenes having a molecular weight of 200 to 350, and 0.01 to 5.0% by weight (based on the total amount of the oil composition) of a phosphoric ester compound.

In a third aspect of this invention, there is provided a fluid composition for use in a refrigerator which comprises;

[I] an HFC refrigerant containing HFC-134a and/or HFC-125; and

[II] a refrigerator oil comprising an alkylbenzene oil containing 60% by weight or more of alkylbenzenes having a molecular weight of 200 to 350.

In a further aspect of this invention, there is provided a fluid composition for use in a refrigerator which comprises;

[I] an HFC refrigerant containing HFC-134a and/or HFC-125; and

[II] an alkylbenzene oil containing 60% by weight or more of alkylbenzenes having a molecular weight of 200 to 350 as a base oil, which base oil is mixed with 0.01 to 5.0% by weight (based on the total amount of the oil composition) of a phosphoric ester compound.

This invention will be further explained in detail with reference to the following preferred embodiments.

The refrigerator oil proposed by this invention comprises an alkylbenzene oil containing at least 60% by weight of alkylbenzenes having a molecular weight of 200 to 350.

To be more specific, it is required for the alkylbenzene oil to contain at least 60% by weight, preferably at least 65% by weight, more preferably at least 70% by weight, still more preferably at least 80% by weight, most preferably 100% by weight of alkylbenzenes having a molecular weight of 200 to 350. If there is employed an alkylbenzene oil containing less than lower limit of alkylbenzenes having a molecular weight of 200 to 350, the seizure of a refrigerating compressor used may possibly be caused after a long period of operation, thus undesirably affecting the reliability of the refrigerator oil.

Further, in view of improving the property for preventing the generation of seizure of refrigerating compressor during a long period of operation, the alkylbenzene oil may desirably be selected from those containing 30% by weight or more, more preferably 35% by weight or more, most preferably 40% by weight or more of alkylbenzenes having a molecular weight of 200 to 300.

As for the alkylbenzene oil constituting a refrigerator oil of this invention, there is no restriction with respect to the molecular structure of the component alkylbenzenes as far as the molecular weight thereof falls within the range of from 200 to 350. However, in view of improving a long-term reliability of a refrigerating system, it is preferable to select an alkylbenzene (A) having 1 to 4 alkyl groups, each group containing 1 to 19 carbon atoms and the total amount of carbon atoms in the alkyl groups being 9 to 19, and more preferably to select an alkylbenzene having 1 to 4 alkyl groups, each group containing 1 to 15 carbon atoms and the total amount of carbon atoms in the alkyl groups being 9 to 15.

Examples of alkyl group containing 1 to 19 carbon atoms are methyl, ethyl, propyl (including all isomers), butyl (including all isomers), pentyl (including all isomers), hexyl (including all isomers), heptyl (including all isomers), octyl (including all isomers), nonyl (including all isomers), decyl (including all isomers), undecyl (including all isomers), dodecyl (including all isomers), tridecyl (including all isomers), tetradecyl (including all isomers), pentadecyl (including all isomers), hexadecyl (including all isomers), heptadecyl (including all isomers), octadecyl (including all isomers) and nonadecyl (including all isomers).

These alkyl groups may be of a straight chain or a branched chain. However, in view of the stability and viscosity of the alkylbenzenes, branched-chain alkyl groups are preferable, and the branched-chain alkyl groups that can be derived from oligomers of olefins such as propylene, butene and isobutylene in view of availability.

The number of alkyl groups in the alkylbenzene defined in the above (A) is confined to 1 to 4. However, in view of stability and availability of the alkylbenzene, it is the most preferable to select an alkylbenzene having one or two alkyl groups, i.e., a monoalkylbenzene, a dialkylbenzene or a mixture of them.

It is also possible to employ not only the alkylbenzenes defined in the above (A) which have the same molecular structure, but also those having different molecular structures as long as there are satisfied the conditions that they contain 1 to 4 alkyl groups, each group containing 1 to 19 carbon atoms and the total amount of carbon atoms in the alkyl groups being 9 to 19.

It is permissible for the alkylbenzene oil constituting the refrigerator oil of this invention to contain less than 40% by weight, preferably less than 35% by weight, or more preferably less than 30% by weight, of alkylbenzenes having a molecular weight of less than 200 or more than 350. However, it is preferable that the molecular weight of such alkylbenzenes is confined to a range of more than 350 to 450, more preferably more than 350 to 430, in view of retaining reliability during a long period of operation of a compressor used.

With respect to the alkylbenzenes having a molecular weight ranging from more than 350 to 450, there are no restrictions imposed on the molecular structure thereof as far as the molecular weights fall within this range. However, in view of stability and availability of alkylbenzenes, it is preferable to select an alkylbenzene (B) having 1 to 4 alkyl groups, each group containing 1 to 40 carbon atoms and the total amount of carbon atoms in the alkyl groups being 20 to 40, and more preferably to select an alkylbenzene having 1 to 4 alkyl groups, each group containing 1 to 30 carbon atoms and the total amount of carbon atoms in the alkyl groups being 20 to 30.

Examples of alkyl group containing 1 to 40 carbon atoms are methyl, ethyl, propyl (including all isomers), butyl (including all isomers), pentyl (including all isomers), hexyl (including all isomers), heptyl (including all isomers), octyl (including all isomers), nonyl (including all isomers), decyl (including all isomers), undecyl (including all isomers), dodecyl (including all isomers), tridecyl (including all isomers), tetradecyl (including all isomers), pentadecyl (including all isomers), hexadecyl (including all isomers), heptadecyl (including all isomers), octadecyl (including all isomers), nonadecyl (including all isomers), icosyl (including all isomers), henicosyl (including all isomers), docosyl (including all isomers), tricosyl (including all isomers), tetracosyl (including all isomers), pentacosyl (including all isomers), hexacosyl (including all isomers), heptacosyl (including all isomers), octacosyl (including all isomers), nonacosyl (including all isomers), triacontyl (including all isomers), hentriacontyl (including all isomers), dotriacontyl (including all isomers), tritriacontyl (including all isomers), tetratriacontyl (including all isomers), pentatriacontyl (including all isomers), hexatriacontyl (including all isomers), heptatriacontyl (including all isomers), octatriacontyl (including all isomers), nonatriacontyl (including all isomers) and tetracontyl (including all isomers).

These alkyl groups may be straight-chain or branched-chain ones. However, in view of the stability and viscosity of the alkylbenzene, branched-chain alkyl groups are preferable; and branched-chain alkyl groups that can be derived from an oligomer of an olefin such as propylene, butene or isobutylene, are more preferable in view of their availability.

The number of alkyl group in the alkylbenzene defined in the above (B) is confined to 1 to 4. However, in view of stability and availability of the alkylbenzene, it is the most preferable to select an alkylbenzene having one or two alkyl groups, i.e., a monoalkylbenzene, a dialkylbenzene or a mixture of them.

It is also possible to employ not only the alkylbenzenes defined in the above (B) which have the same molecular structure, but also those having different molecular structures as long as there are satisfied the conditions that they contain 1 to 4 alkyl groups, each group containing 1 to 40 carbon atoms and the total amount of carbon atoms in the alkyl groups being 20 to 40.

Although there is no specific restriction imposed on the viscosity of the alkylbenzene oil constituting the refrigerator oil of this invention, it is preferable to select alkylbenzenes having a kinematic viscosity of 3 to 50 $mm^2/s$, more preferably 4 to 40 $mm^2/s$, and most preferably 5 to 35 $mm^2/s$ at a temperature of 40° C.

Though there is no restriction placed on the manufacturing method of the alkylbenzene oil constituting the refrigerator oil of this invention, the alkylbenzene oil can be manufactured according to the following synthesizing methods.

Aromatic compounds which may be used as a raw material include benzene, toluene, xylene, ethylbenzene, methylethylbenzene, diethylbenzene and a mixture thereof. Alkylating agents which may be used herein, include a lower mono-olefin such as ethylene, propylene, butene or isobutylene; preferably an olefin of a straight chain or branched chain having 6 to 40 carbon atoms that can be derived from the polymerization of propylene; an olefin of a straight chain or branched chain having 6 to 40 carbon atoms that can be derived from the thermal decomposition of wax, heavy oil, a petroleum fraction, polyethylene or polypropylene; an olefin of a straight chain having 6 to 40 carbon atoms that can be obtained by separating n-paraffin from a petroleum fraction such as kerosine or gas oil and then catalytically transforming the rest of the paraffin into an olefin; and a mixture of these olefins.

An alkylating catalyst for use in the alkylation includes a conventional catalyst exemplified by a Friedel-Crafts catalyst such as aluminum chloride or zinc chloride; or an acidic catalyst such as sulfuric acid, phosphoric acid, silicotungstic acid, hydrofluoric acid or activated clay.

The alkylbenzene oil of this invention may be obtained by mixing separately prepared alkylbenzenes having a molecular weight ranging from 200 to 350 with alkylbenzenes having a molecular weight of less than 200 or more than 350 in a ratio as defined by this invention. However, it is advisable in practice to obtain a distillate containing at least 60% by weight of alkylbenzenes having a molecular weight ranging from 200 to 350 through distillation or chromatography from a mixture of alkylbenzenes which is manufactured according to the method explained above or is available in the market.

The refrigerator oil of this invention comprises the alkylbenzene oil as defined above, which can be suitably used as a refrigerator oil for an HFC refrigerant containing HFC-134a and/or HFC-125 without accompaniment of an additive. However, it is also possible to use in the form of a refrigerator oil composition containing therein any of various additives as required.

In particular, it is preferable, in view of improving the refrigerating apparatus in wear resistance and load resistance, to blend a refrigerator oil with at least one kind of phosphorus compound selected from the group consisting of phosphoric esters, acid phosphoric esters, amine salts of acid phosphoric esters, chlorinated phosphoric esters and phosphorous esters.

These phosphorus compounds are esters obtained by a reaction between phosphoric acid or phosphorous acid with an alkanol or a polyether type alcohol, or such phosphorus compounds are derivatives of the esters.

Phosphoric esters used herein include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylyl phosphate, cresyldiphenyl phosphate and xylydiphenyl phosphate.

Acid phosphoric esters used herein include monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dioctadecyl acid phosphate and dioleyl acid phosphate. Examples of amine salt of acid phosphoric ester are methyl amine, ethyl amine, propyl amine, butyl amine, pentyl amine, hexyl amine, heptyl amine, octyl amine, dimethyl amine, diethyl amine, dipropyl amine, dibutyl amine, dipentyl amine, dihexyl amine, diheptyl amine, dioctyl amine, trimethyl amine, triethyl amine, tripropyl amine, tributyl amine, tripentyl amine, trihexyl amine, triheptyl amine and trioctyl amine of the acid phosphoric ester. Examples of chlorinated phosphoric ester are tris-dichloropropyl phosphate, tris-chloroethyl phosphate, tris-chlorophenyl phosphate and polyoxyalkylene bis[di (chloroalkyl)] phosphate. Examples of phosphorous ester are dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite and tricresyl phosphite. It is also possible to use a mixture of these compounds.

These phosphorus compounds may be blended into a refrigerator oil in any desired mixing ratio. However, it is generally preferable to blend these phosphorus compounds in the ratio of 0.005 to 5.0% by weight, more preferably 0.01 to 3.0% by weight based on the total amount of the refrigerator oil composition (a total of the alkylbenzene oil of this invention and the whole additives).

If the amount of the phosphorus compound added is less than 0.005% by weight based on the total amount of the refrigerator oil composition, any substantial effect on the improvement of wear resistance and load resistance would not be attained by the addition of said compound. On the other hand, if the amount of the phosphorus compound added exceeds 5.0% by weight based on the total amount of the refrigerator oil composition, it may give rise to the undesirable generation of corrosion in a refrigerating system during its use for a long period of time.

The improvement in wear resistance and load resistance to be attained by the addition of the phosphorus compound is one of the features of this invention. It is certainly possible to achieve more or less an improvement in wear resistance and load resistance, even with the use of PAG (polyalkylene glycol) or an ester which is each known as useful for HFC refrigerator oil. However, the effect that can be attained by the use of these conventional compounds is far less than the effect to be achieved by the use of the refrigerator oil of this invention.

It is also possible for the purpose of improving the stability to incorporate in the refrigerator oil of this invention at least one kind of an epoxy compound selected from the group consisting of:

(1) Phenylglycidyl ether type epoxy compounds,
(2) Alkylglycidyl ether type epoxy compounds,
(3) Glycidyl ester type epoxy compounds,
(4) Aryl oxirane compounds,
(5) Alkyl oxirane compounds,
(6) Alicyclic epoxy compounds,
(7) Epoxidized fatty monoesters,
(8) Epoxidized vegetable oils.

Examples of phenylglycidyl ether type epoxy compounds (1) are phenylglycidyl ether and alkylphenylglycidyl ether. The alkylphenylglycidyl ether used herein may be one having 1 to 3 alkyl groups each containing 1 to 13 carbon atoms, preferably one having one alkyl group containing 4 to 10 carbon atoms. Examples of such preferable alkylphenylglycidyl ether are n-butylphenylglycidyl ether, i-butylphenylglycidyl ether, sec-butylphenylglycidyl ether, tert-butylphenylglycidyl ether, pentylphenylglycidyl ether, hexylphenylglycidyl ether, heptylphenylglycidyl ether, octylphenylglycidyl ether, nonylphenylglycidyl ether and decylphenylglycidyl ether.

Examples of alkylglycidyl ether type epoxy compounds (2) are decylglycidyl ether, undecylglycidyl ether, dodecylglycidyl ether, tridecylglycidyl ether, tetradecylglycidyl ether, 2-ethylhexylglycidyl ether, neopentylglycoldiglycidyl ether, trimethylolpropane triglycidyl ether, pentaerythritol tetraglycidyl ether, 1,6-hexadiol diglycidyl ether, sorbitol polyglycidyl ether, polyalkyleneglycol monoglycidyl ether and polyalkyleneglycol diglycidyl ether.

Examples of glycidyl ester type epoxy compounds (3) are phenylglycidyl ester, alkylglycidyl ester and alkenylglycidyl ester. Preferable examples thereof are glycidyl 2,2-dimethyloctanoate, glycidyl benzoate, glycidyl acrylate and glycidyl methacrylate.

Examples of aryl oxirane compounds (4) are 1,2-epoxystyrene and alkyl-1,2-epoxystyrene.

Examples of alkyl oxirane compounds (5) are 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,2-epoxyoctadecane, 1,2-epoxynonadecane and 1,2-epoxyicosane.

Examples of alicyclic epoxy compounds (6) are 1,2-epoxycyclohexane, 1,2-epoxycyclopentane, 3,4-epoxycyclohexylmethyl-3,4-epoxycyclohexane carboxylate, bis(3,4-epoxycyclohexylmethyl) adipate, exo-2,3-epoxynorbornane, bis(3,4-epoxy-6-methylcyclohexylmethyl) adipate, 2-(7-oxabicyclo[4.1.0]hept-3-yl)-spiro(1,3-dioxane-5,3'-[7]oxabicyclo[4.1.0])heptane, 4-(1'-methylepoxyethyl)-1,2-epoxy-2-methylcyclohexane and 4-epoxyethyl-1,2-epoxycyclohexane.

Examples of epoxidized fatty monoesters (7) are an ester formed through a reaction between an epoxidized fatty acid having 12 to 20 carbon atoms and an alcohol having 1 to 8 carbon atoms, phenol or an alkylphenol. In particular, epoxystearates such as butyl, hexyl, benzyl, cyclohexyl, methoxyethyl, phenyl and butylphenyl esters of epoxystearic acid are preferred.

Examples of epoxidized vegetable oils (8) are epoxy compounds of a vegetable oil such as soybean oil, linseed oil or cottonseed oil.

Among these epoxy compounds, phenylglycidyl ether type epoxy compounds, glycidyl ester type epoxy compounds, alicyclic epoxy compounds and epoxidized fatty monoester are preferred. Among them, phenylglycidyl ether type epoxy compounds and glycidyl ester type epoxy compounds are more preferred. The most preferable epoxy compounds are phenylglycidyl ether, butylphenylglycidyl ether and alkylglycidyl esters.

These epoxy compounds may be blended into a refrigerating machine oil in any desired mixing ratio. However, it is generally preferable to blend these epoxy compounds in the ratio of 0.1 to 5.0% by weight, more preferably 0.2 to 2.0% by weight, based on the total amount of the refrigerating machine oil composition (a total of the alkylbenzene oil of this invention and the whole additives).

It is of course possible to employ these phosphorus compounds and epoxy compounds jointly.

It is also possible, if required, to use singly or jointly suitable conventional additives in the refrigerating machine oil for the purpose of improving the oil in properties. The suitable conventional additives include anti-oxidants of a phenol type such as di-tert-butyl-p-cresol and bisphenol A or of an amine type such as phenyl-o-naphthyl amine and N,N-di(2-naphthyl)-p-phenylene diamine; wear resistant additives such as zinc dithiophosphate; extreme pressure agents such as chlorinated paraffin and sulfur compounds; oiliness improvers such as a fatty acid; anti-foaming agents such as silicone-type ones; metal inactivators such as benzotriazole; viscosity index improvers; pour point depressants; and detergent-dispersants. These additives may be used singly or in combination. These additives can be generally added in a ratio of not more than 10% by weight, more preferably not more than 5% by weight, based on the total amount of the refrigerating machine oil composition (a total of the alkylbenzene oil of this invention and the whole additives).

The refrigerants used for a refrigerating machine together with the refrigerating machine oil of this invention, include an alkane fluoride having 1 to 3 carbon atoms, preferably 1 to 2 carbon atoms and containing 40% by weight or more of 1,1,1,2-tetrafluoroethane (HFC-134a) and/or an alkane fluoride having 1 to 3 carbon atoms, preferably 1 to 2 carbon atoms and containing 20% by weight or more, preferably 30% by weight or more, more preferably 40% by weight or more of pentafluoroethane (HFC-125).

There is no restriction as to the kind of HFC (hydrofluorocarbon) to be mixed with HFC-134a and/or HFC-125. The HFC includes trifluoromethane (HFC-23), difluoromethane (HFC-32), 1,1,2,2-tetrafluoroethane (HFC-134), 1,1,1-trifluoroethane (HFC-143a) or 1,1-difluoroethane (HFC-152a).

Examples of the HFC refrigerant containing 1,1,1,2-tetrafluoroethane (HFC-134a) and/or pentafluoroethane (HFC-125) that are useful in this invention are HFC-134a alone, HFC-125 alone, a mixture of HFC-134a/HFC-32 in a ratio of 60–80% by weight/40–20% by weight; a mixture of HFC-134a/HFC-32/HFC-125 in a ratio of 40–70% by weight/15–35% by weight/5–40% by weight, a mixture of HFC-125/HFC-32 in a ratio of 30–60% by weight/70–40% by weight, a mixture of HFC-125/HFC-143a in a ratio of 40–60% by weight/60–40% by weight and a mixture of HFC-125/HFC-134a/HFC-143a in a ratio of 35–55% by weight/1–15% by weight/40–60% by weight.

Specific examples of the HFC refrigerant mixture are R404A (HFC-125/HFC-143a/HFC-134a in a ratio of 44% by weight/52% by weight/4% by weight), R4078C (HFC-32/HFC-125/HFC-134a in a ratio of 23% by weight/25% by weight/52% by weight), R410A (HFC-32/HFC-125 in a ratio of 50% by weight/50% by weight), R410B (HFC-32/HFC-125 in a ratio of 45% by weight/55% by weight) and R507 (HFC-125/HFC-143a in a ratio of 50% by weight/50% by weight.

The refrigerator oil according to this invention is generally present in a refrigerator as a composition in which the refrigerator oil is mixed with an alkane fluoride as mentioned above. The mixing ratio between the refrigerator oil and the alkane fluoride in this composition may be optionally determined, but is generally a ratio of 1 to 500 parts by weight, preferably 2 to 400 parts by weight, of the refrigerator oil per 100 parts by weight of the alkane fluoride.

Since the refrigerator oil according to this invention is excellent in electric properties and low in hygroscopicity, it is particularly suited for use in an air conditioner or a refrigerator provided with a sealed compressor of a reciprocating type or rotary type. This refrigerator oil is also suited for use in an air conditioner or dehumidifier for vehicles, a freezer, a refrigerating chamber, an automatic vending machine, a show-case or a cooling system for a chemical plant. This refrigerator oil is also applicable to a compressor of a centrifugal type.

DESCRIPTION OF THE PREFERRED EMBODIMENTS

This invention will be further explained with reference to the following examples and comparative examples. However, it should be noted that these examples are not intended to restrict in any manner the scope of this invention.

EXAMPLES 1 to 14 AND COMPARATIVE EXAMPLES 1 to 9

The properties of the base oils used in these Examples and Comparative Examples are represented in Table 1, and the additives used therein are shown in Table 2. The distribution of molecular weights of alkylbenzenes in mixture was measured by means of mass spectrometry.

TABLE 1

| | Kinematic viscosity ($mm^2/s$) | | Molecular wt. distribution (wt. %) | | | |
|---|---|---|---|---|---|---|
| Base oil | 40° C. | 100° C. | <200 | 200–300 | 301–350 | >350 |
| A Alkyl benzene (branched-chain type) | 8.3 | 2.10 | 5 | 93 | 2 | 0 |
| B Alkyl benzene (branched-chain type) | 15.3 | 2.94 | 4 | 68 | 14 | 14 |
| C Alkyl benzene (branched-chain type) | 16.9 | 3.15 | 20 | 20 | 19 | 41 |
| D Alkyl benzene (branched-chain type) | 12.6 | 2.62 | 0 | 83 | 15 | 2 |
| E Alkyl benzene (branched-chain type) | 29.0 | 4.30 | 2 | 49 | 24 | 25 |
| F Alkyl benzene (branched-chain type) | 35.2 | 4.52 | 2 | 38 | 35 | 25 |
| G Alkyl benzene (branched-chain type) | 60.8 | 5.91 | 3 | 32 | 30 | 35 |
| H Alkyl benzene (branched-chain type) | 72.6 | 6.40 | 3 | 22 | 26 | 49 |
| I Alkyl benzene (straight-chain type) | 15.4 | 3.18 | 0 | 61 | 30 | 9 |
| J Alkyl benzene (straight-chain type) | 25.6 | 4.33 | 1 | 45 | 43 | 11 |
| K Naphthenic mineral oil (commercially available) | 32.5 | 4.71 | — | — | — | — |
| L Tetraester (produced from pentaerythritol/2-ethylhexanoic acid) | 45.1 | 6.28 | — | — | — | — |
| M Polypropylene glycol monobutyl ether | 32.5 | 6.71 | Number-average Mol. Wt. 690 | | | |
| N Alkyl benzene (branched-chain type) | 15.2 | 2.90 | 1 | 72 | 17 | 10 |

[Note]

A, C, D, E, F, H and N: These oils were produced by distilling a mixture of monoalkylbenzenes and dialkylbenzenes which had been prepared from, as raw materials, benzene and a branched-chain olefin consisting of 2 to 8 propylene monomers and having 6 to 24 carbon atoms by reacting them in the presence of hydrofluoric acid as an alkylating catalyst.

B: A mixture of A and E (50% by weight:50% by weight).

G: A product obtained by the re-distillation of H.

I and J: These oils were produced by distilling a mixture of monoalkylbenzenes and dialkylbenzenes which had been prepared from, as raw materials, benzene and n-paraffin having 9 to 18 carbon atoms and separated from a kerosene fraction by reacting them in the presence of hydrofluoric acid as an alkylating catalyst.

TABLE 2

| Additive | Name of Compound |
|---|---|
| A | Tricresyl phosphate |
| B | Dioleylhydrogen phosphate |
| C | Di(2-ethylhexyl) acid phosphate |
| D | Para-tertiarybutylphenylglycidyl ether |
| E | Neodecanoic glycidyl ester |
| F | 2,6-ditertiarybutyl-p-cresol |

Various kinds of refrigerator oils of this invention were prepared respectively from the materials having the compositions shown in Table 3 (Examples 1–14).

The refrigerator oils thus obtained were subjected to an evaluation test for their long-term operability as indicated below.

Evaluation Test 1

A household room air conditioner having a refrigerating capacity of 2.5 kw and filled with 350 g of a test oil and 1000 g of a mixed refrigerant consisting of HFC-134a/HFC-32 in a ratio by weight of 70% to 30%, was placed in a thermostatic room kept at an atmospheric temperature of 43° C. and then subjected to continuous operation of 500 hours while setting the air conditioner to maintain the room at 25° C., in order to evaluate the test oil for its operability.

Evaluation Test 2

A household three-door type refrigerator having an effective inner volume of 300 liters was filled with 180 g of a refrigerant consisting of HFC-134a and 150 g of a test oil, was housed in a thermostatic room kept at an atmospheric temperature of 43° C. and then subjected to continuous operation of 500 hours while setting the temperatures of the freezing chamber and the cooling chamber to −18° C. and 3° C. respectively, in order to evaluate the test oil for its operability (or performance).

Evaluation Test 3

An evaluation test was conducted using the same test oils as those which were recognized as being excellent in the above Evaluation Tests 1 and 2, by the use of a rolling piston type compressor in which 50 g of a refrigerant consisting of HFC-134a and 70 g of the test oil were filled. Then, the compressor so filled was subjected to continuous operation of 1000 hours under the conditions of a delivery pressure of 16 kgf/cm$^2$G, an inlet pressure of 0 kgf/cm$^2$G, a revolving speed of 3000 rpm and a test temperature of 160° C. After 1000 hours of the test, the surface roughness of sliding surface portion of the compressor vanes was measured.

For the purpose of comparison, the same evaluation tests as those conducted above were also performed on the refrigerator oils having respective various compositions as indicated in Table 4, i.e., a composition comprising only an alkylbenzene oil (mixture) containing less than 60% by weight of alkylbenzenes having a molecular weight of 200 to 350 (Comparative Examples 1 and 3); a composition comprising an additive and an alkylbenzene oil containing less than 60% by weight of alkylbenzenes having a molecular weight of 200 to 350 (Comparative Examples 2 and 4); a composition comprising a naphthene-based mineral oil incorporated with an additive (Comparative Example 5); a composition containing only pentaerythritol ester (Comparative Example 6); a composition containing only pentaerythritol ester incorporated with an additive (Comparative Example 7); a composition containing only polypropylene glycol monoalkyl ether (Comparative Example 8); and a composition containing only polypropylene glycol monoalkyl ether incorporated with an additive (Comparative Example 9). The results of these tests are also shown in Table 4.

TABLE 3

| | | | Example | | | | | | | | |
|---|---|---|---|---|---|---|---|---|---|---|---|
| | | | 1 | 2 | 3 | 4 | 5 | 6 | 7 | 8 | 9 |
| Composition (wt. %) | Base Oil | | A [100.0] | B [100.0] | D [100.0] | E [99.5] | F [99.9] | G [99.3] | B [97.0] | D [99.9] | G [98.5] |
| | Additive | A | — | — | — | — | — | — | [3.0] | — | [1.0] |
| | | B | — | — | — | — | — | — | — | [0.1] | — |
| | | C | — | — | — | — | — | — | — | — | — |
| | | D | — | — | — | — | — | [0.7] | — | — | — |
| | | E | — | — | — | [0.5] | — | — | — | — | — |
| | | F | — | — | — | — | [0.1] | — | — | — | [0.1] |
| Performances evaluated | Test 1 | | S | S | S | S | S | S | S | S | S |
| | Test 2 | | S | S | S | S | S | S | S | S | S |
| | Test 3 (μm) | | 0.15 | 0.14 | 0.15 | 0.12 | 0.14 | 0.13 | 0.03 | 0.05 | 0.03 |

| | | | Example | | | | |
|---|---|---|---|---|---|---|---|
| | | | 10 | 11 | 12 | 13 | 14 |
| Composition (wt. %) | Base Oil | | G [99.2] | I [98.0] | J [98.7] | N [100.0] | N [98.9] |
| | Additive | A | — | [1.0] | [0.5] | — | [1.0] |
| | | B | — | — | — | — | — |
| | | C | [0.1] | — | — | — | — |
| | | D | [0.7] | [1.0] | — | — | — |
| | | E | — | — | [0.5] | — | — |
| | | F | — | — | [0.3] | — | [0.1] |
| Performances evaluated | Test 1 | | S | S | S | S | S |
| | Test 2 | | S | S | S | S | S |
| | Test 3 (μm) | | 0.03 | 0.04 | 0.05 | 0.12 | 0.03 |

Note: S = Satisfactory

TABLE 4

| | | | Comparative Example | | | | | | | | |
|---|---|---|---|---|---|---|---|---|---|---|---|
| | | | 1 | 2 | 3 | 4 | 5 | 6 | 7 | 8 | 9 |
| Composition (wt. %) | Base Oil | | C [100.0] | C [97.0] | H [100.0] | H [99.2] | K [98.9] | L [100.0] | L [98.9] | M [100.0] | M [98.9] |
| | Additive | A | — | [3.0] | — | — | [1.0] | — | [1.0] | — | [1.0] |
| | | B | — | — | — | — | — | — | — | — | — |
| | | C | — | — | — | [0.1] | — | — | — | — | — |
| | | D | — | — | — | [0.7] | — | — | — | — | — |
| | | E | — | — | — | — | — | — | — | — | — |
| | | F | — | — | — | — | [0.1] | — | [0.1] | — | [0.1] |
| Performances evaluated | Test 1 | | 110h | 125h seized | 365h seized | 375h seized | 450h seized | S seized | S | S | S |
| | Test 2 | | 140h seized | 155h seized | 370h seized | 390h seized | 480h seized | S | S | S | S |
| | Test 3 (μm) | | — | — | — | — | — | 0.49 | 0.50 | 0.79 | 0.76 |

Note: S = Satisfactory

EXAMPLES 15 to 28 AND COMPARATIVE EXAMPLES 10 to 18

There were prepared various kinds of the refrigerator oils of this invention having their respective compositions shown in Table 5 (Examples 15 to 28).

The refrigerator oils thus prepared were subjected to an evaluation test for their long-term operability as indicated below. The results obtained are shown in Table 5.

Evaluation Test 4

A household room air conditioner having a refrigerating capacity of 2.5 KW was filled with 350 g of a test oil and 1000 g of a mixed refrigerant consisting of HFC-125/HFC-32/HFC-134a in a ratio of 25% by weight/52% by weight/23% by weight, placed in a thermostatic room kept at an atmospheric temperature of 43° C., and then subjected to continuous operation of 500 hours while setting the air conditioner to maintain the room at 25° C., in order to evaluate the test oil for its operability (or performance).

Evaluation Test 5

A household three-door type refrigerator having an effective inner volume of 300 L was filled with 150 g of a test oil and 180 g of a mixed refrigerant consisting of HFC-125/HFC-134a/HFC-143a in a ratio of 44% by weight/4% by weight/52% by weight, placed in a thermostatic room whose atmospheric temperature was kept at 43° C. and then subjected to continuous operation of 500 hours while setting the temperatures of the freezing chamber and the cooling chamber to −18° C. and 3° C. respectively, in order to evaluate the test oil for operability (performance).

Evaluation Test 6

An evaluation test was conducted using the same test oils as those which were recognized as being excellent in the above Evaluation Tests 4 and 5, by the use of a rolling piston type compressor in which 70 g of the test oil and 50 g of a mixed refrigerant consisting of HFC-125/HFC-32 in a ratio of 50% by weight/50% by weight were filled. Then, the compressor so filled was subjected to continuous operation of 1000 hours under the conditions of a delivery pressure of 16 kgf/cm$^2$G, an inlet pressure of 0 kgf/cm$^2$G, a revolving speed of 3000 rpm and a test temperarure of 160° C. After 1000 hours of the test, the surface roughness of sliding surface portion of the compressor vanes was measured.

For the purpose of comparison, the same evaluation tests as conducted above were also performed on the refrigerator oils having various compositions as indicated in Table 6, i.e., a composition comprising only an alkylbenzene oil (mixture) containing less than 60% by weight of alkylbenzenes having a molecular weight of 200 to 350 (Comparative Examples 10 and 12); a composition comprising an additive and an alkylbenzene oil (mixture) containing less than 60% by weight of alkylbenzenes having a molecular weight of 200 to 350 (Comparative Examples 11 and 13); a composition comprising a naphthene-based mineral oil incorporated with an additive (Comparative Example 14); a composition containing only pentaerythritol ester (Comparative Example 15); a composition containing pentaerythritol ester incorporated with an additive (Comparative Example 16); a composition containing polypropyleneglycol monoalkyl ether (Comparative Example 17); and a composition containing only polypropylene glycol monoalkyl ether incorporated with an additive (Comparative Example 18). The results of these tests are also shown in Table 6.

TABLE 5

| | | | Example | | | | | | | | |
|---|---|---|---|---|---|---|---|---|---|---|---|
| | | | 15 | 16 | 17 | 18 | 19 | 20 | 21 | 22 | 23 |
| Composition (wt. %) | Base Oil | | A [100.0] | B [100.0] | D [100.0] | E [100.0] | F [99.9] | G [100.0] | B [97.0] | D [99.9] | F [98.9] |
| | Additive | A | — | — | — | — | — | — | [3.0] | — | [1.0] |
| | | B | — | — | — | — | — | — | — | [0.1] | — |
| | | C | — | — | — | — | — | — | — | — | — |
| | | F | — | — | — | — | [0.1] | — | — | — | [0.1] |
| Performance evaluated | Test 4 | | S | S | S | S | S | S | S | S | S |
| | Test 5 | | S | S | S | S | S | S | S | S | S |
| | Test 6 (μm) | | 0.17 | 0.15 | 0.15 | 0.14 | 0.16 | 0.14 | 0.02 | 0.05 | 0.04 |

TABLE 5-continued

| | | | Example | | | | |
|---|---|---|---|---|---|---|---|
| | | | 24 | 25 | 26 | 27 | 28 |
| Composition (wt. %) | Base Oil | | G [99.9] | I [99.0] | J [99.4] | N [100.0] | N [98.9] |
| | Additive | A | — | [1.0] | [0.5] | — | [1.0] |
| | | B | — | — | — | — | — |
| | | C | [0.1] | — | — | — | — |
| | | F | — | — | [0.1] | — | [0.1] |
| Performances evaluated | Test 4 | | S | S | S | S | S |
| | Test 5 | | S | S | S | S | S |
| | Test 6 (μm) | | 0.03 | 0.05 | 0.04 | 0.14 | 0.04 |

Note: S = Satisfactory

TABLE 6

| | | | Comparative Example | | | | | | | | |
|---|---|---|---|---|---|---|---|---|---|---|---|
| | | | 10 | 11 | 12 | 13 | 14 | 15 | 16 | 17 | 18 |
| Composition (wt. %) | Base Oil | | C [100.0] | C [97.0] | H [100.0] | H [99.9] | K [98.9] | L [100.0] | L [98.9] | M [100.0] | M [98.9] |
| | Additive | A | — | [3.0] | — | — | [1.0] | — | [1.0] | — | [1.0] |
| | | B | — | — | — | — | — | — | — | — | — |
| | | C | — | — | — | [0.1] | — | — | — | — | — |
| | | F | — | — | — | — | [0.1] | — | [0.1] | — | [0.1] |
| Performances evaluated | Test 4 | | 135h seized | 160h seized | 395h seized | 420h seized | 450h seized | S | S | S | S |
| | Test 5 | | 150h seized | 190h seized | 445h seized | 450h seized | unstable | S | S | S | S |
| | Test 6 (μm) | | — | — | — | — | — | 0.45 | 0.44 | 0.61 | 0.59 |

Note: S = Satisfactory

As apparent from the results of the performance evaluation tests shown in Tables 3 and 5, the refrigerator oils of Examples 1 to 28 according to this invention did not cause the seizure of refrigerating compressor and were excellent in lubricity, thus making it possible to maintain high reliability for a long period of time.

The refrigerator oil compositions of Examples 7 to 12, 14, 21 to 26 and 28, each containing a phosphorus compound, indicated a remarkable improvement in the surface roughness of sliding surface portion of the compressor vanes over the phosphorus compound-free refrigerator oil compositions of Examples 1 to 6, 13, 15 to 20 and 27, thus clearly demonstrating the remarkable effect of the phosphorus compound on the improvement in wear resistance.

By contrast, when there were used the refrigerator oil compositions of Comparative Examples 1 to 4 and 10 to 13 shown respectively in FIGS. 4 and 6, each comprising an alkylbenzene oil containing less than 60% by weight of alkylbenzenes having a molecular weight ranging from 200 to 350, the seizure of refrigerating compressor was recognized, thus indicating that they cannot be reliably used for a long period of time. It was also recognized that the generation of the seizure of refrigerating compressor could not be avoided even if a phosphorus compound was added to these refrigerator oil compositions of the Comparative Examples. This tendency was also recognized in the cases of Comparative Examples 5 and 14 using a naphthene-based mineral oil.

On the other hand, when the refrigerator oil compositions of Comparative Examples 6 and 15, each comprising only pentaerythritol ester, and of Comparative Examples 8 and 17, each comprising only polypropylene glycol monoalkyl ether, were used, they indicated far poor wear resistance as compared with the refrigerator oil of this invention, even though the seizure of refrigerating compressor was not appreciated.

Meanwhile, the refrigerator oil compositions of Comparative Examples 7, 16, 9 and 18, each comprising a phosphorus compound, were found to have hardly improved refrigerating apparatus in wear resistance as compared with the oil compositions (comprising no phosphorus compound) of Comparative Examples 6, 15, 8, and 17. This clearly demonstrates a synergistic effect of the base oil (alkylbenzene oil containing at least 60% by weight of alkylbenzenes having a molecular weight of 200 to 350) of this invention and a phosphorus compound incorporated therein.

As explained above, the refrigerator oil of this invention is suited for use in an HFC refrigerant containing HFC-134a and/or HFC-125, and featured in that it enables the generation of seizure of refrigerating compressor to be avoided and is excellent in lubricity, thus making it possible to maintain high reliability for a long period of time. This refrigerator oil of this invention can be suitably used as a fluid composition for use in a refrigerator by mixing it with an HFC refrigerant containing HFC-134a and/or HFC-125.

What is claimed is:

1. A fluid composition for use in a refrigerating machine which comprises:

(I) an HFC refrigerant containing at least one of HFC-134a and HFC-125; and (II) 1 to 500 parts by weight of a refrigerating machine oil comprising an alkylbenzene oil containing at least 60% by weight of alkylbenzenes having a molecular weight of 200 to 350 and having kinematic viscosity of from 3 to less than 72.6 $mm^2/s$ at a temperature of 40° C. per 100 pats by weight of the HFC refrigerant as a base oil and 0.005 to 5.0% by weight, based on the total amount of the oil composition, of at least one kind of phosphorus compound selected from the group consisting of phosphoric esters, acid phosphoric esters, amine salts of acid phosphoric esters, chlorinated phosphoric esters and phosphorous esters.

2. A fluid composition for use in a refrigeration machine comprising:

an HFC refrigerant; and a refrigerating machine oil, said refrigerating machine oil comprising an alkylbenzene oil containing at least 60% by weight of alkylbenzenes having a molecular weight of 200 to 350.

3. A fluid composition for use in an refrigerating machine which comprises:

(I) an HFC refrigerant containing at last one of HFC-134a and HFC-125; and (II) 1 to 500 parts by weight of a refrigerating machine oil comprising an alklylbenzene oil containing at least 60% by weight of alkylbenzenes having a molecular weight of 200 to 350 and having a kinematic viscosity of from 3 to less than 72.6 $mm^2/s$ at a temperature of 40° C. per 100 parts by weight of the HFC refrigerant.

4. A fluid composition according to claim 3, wherein said alkylbenzene oil further contains not more than 5% by weight of alkylbenzenes having a molecular weight of less than 200.

5. A fluid composition according to claim 3, wherein said alkylbenzene oil contains at least 65% by weight of alkylbenzenes having a molecular weight of 200 to 350.

6. A fluid composition according to claim 3, wherein said alkylbenzene oil contains at least 70% by weight of alkylbenzenes having a molecular weight of 200 to 350.

7. A fluid composition according to claim 3, wherein said alkylbenzene oil contains at least 80% by weight of alkylbenzenes having a molecular weight of 200 to 350.

8. A fluid composition according to claim 3, wherein said alkylbenzene oil contains 100% by weight of alkylbenzenes having a molecular weight of 200 to 350.

9. A fluid composition according to claim 3, wherein said alkylbenzene oil contains at least 30% by weight of alkylbenzenes having a molecular weight 200 to 300 and at least 60% by weight of alkylbenzenes having a molecular weight of 200 to 350.

10. A fluid composition according to claim 3, wherein said alkylbenzene oil contains at least 35% by weight of alkylbenzenes having a molecular weight 200 to 300 and at least 60% by weight of alkylbenzenes having a molecular weight of 200 to 350.

11. A fluid composition according to claim 3, wherein said alkylbenzene oil contains at least 40% by weight of alkylbenzenes having a molecular weight 200 to 300 and at least 60% by weight of alkylbenzenes having a molecular weight of 200 to 350.

12. A fluid composition according to claim 3, wherein said alkylbenzenes having a molecular weight of 200 to 350 have 1 to 4 alkyl groups, each said alkyl group containing 1 to 19 carbon atoms, and a total number of carbon atoms in said alkyl groups being 9 to 19.

13. A fluid composition according to claim 12, wherein said alkylbenzenes are selected from the group consisting of a monoalkylbenzene, a dialkylbenzene, and a monoalkylbenzene/dialkylbenzene mixture.

14. A fluid composition according to claim 3, wherein said alkylbenzenes having a molecular weight of 200 to 350 include between 1 and 4 alkyl groups, each of said alkyl groups including between 1 and 15 carbon atoms, and a total number of carbon atoms in said alkyl groups being between 9 and 15.

15. A fluid composition according to claim 3, wherein said alkylbenzenes having a molecular weight of 200 to 350 have branched-chain alkyl groups.

16. A fluid composition according to claim 15, wherein said branched-chain alkyl groups are derived from oligomers of olefins.

17. A fluid composition according to claim 3, wherein said alkylbenzene oil further contains less than 35% by weight of alkylbenzenes having a molecular weight of less than 200.

18. A fluid composition according to claim 3, wherein said alkylbenzene oil further contains less than 30% by weight of alkylbenzenes having a molecular weight of less than 200.

19. A fluid composition according to claim 3, wherein said alkylbenzene oil contains less than 20% by weight of alkylbenzenes having a molecular weight of less than 200.

* * * * *